US008059061B2

(12) United States Patent
Ryou et al.

(10) Patent No.: US 8,059,061 B2
(45) Date of Patent: Nov. 15, 2011

(54) SUBMINIATURE INTERNAL ANTENNA

(75) Inventors: Byung-Hoon Ryou, Seoul (KR); Won-Mo Sung, Gyeonggi-do (KR); Jee-Hun Seo, Seoul (KR)

(73) Assignee: EMW Co., Ltd., Seoul (KR)

( * ) Notice: Subject to any disclaimer, the term of this patent is extended or adjusted under 35 U.S.C. 154(b) by 241 days.

(21) Appl. No.: 12/088,074

(22) PCT Filed: Oct. 2, 2006

(86) PCT No.: PCT/KR2006/003963
§ 371 (c)(1),
(2), (4) Date: Sep. 22, 2008

(87) PCT Pub. No.: WO2007/040327
PCT Pub. Date: Apr. 12, 2007

(65) Prior Publication Data

US 2009/0033583 A1 Feb. 5, 2009

(30) Foreign Application Priority Data

Oct. 4, 2005 (KR) ..... 20-2005-0028301

(51) Int. Cl.
*H01Q 1/36* (2006.01)

(52) U.S. Cl. ..... 343/895; 343/741

(58) Field of Classification Search ..... 343/741, 343/866, 895
See application file for complete search history.

(56) References Cited

U.S. PATENT DOCUMENTS

| | | | | |
|---|---|---|---|---|
| 3,019,439 | A * | 1/1962 | Herbert et al. | 343/853 |
| 3,454,951 | A * | 7/1969 | Patterson et al. | 343/895 |
| 3,568,206 | A * | 3/1971 | Sisson et al. | 343/750 |
| 3,825,933 | A * | 7/1974 | Debski et al. | 343/895 |
| 5,929,825 | A | 7/1999 | Niu et al. | |
| 7,542,009 | B2 * | 6/2009 | Hsu et al. | 343/895 |
| 2004/0150562 | A1 | 8/2004 | Paun | |
| 2006/0152411 | A1 * | 7/2006 | Iguchi et al. | 343/700 MS |

FOREIGN PATENT DOCUMENTS

| | | | |
|---|---|---|---|
| DE | 199 04 943 | A1 | 8/2000 |
| DE | 101 10 230 | A1 | 9/2002 |
| EP | 1 443 591 | A1 | 8/2004 |
| KR | 10-2001-0039987 | A | 5/2001 |
| WO | WO 00/03453 | | 1/2000 |
| WO | WO 03/023900 | A1 | 3/2003 |
| WO | WO 2004/025778 | A1 | 3/2004 |
| WO | WO 2007/040327 | A1 | 4/2007 |

OTHER PUBLICATIONS

International Search Report, PCT/KR2006/003963, mailed Jan. 11, 2007, 2 pages.

(Continued)

*Primary Examiner* — Tho G Phan

(74) *Attorney, Agent, or Firm* — Blakely, Sokoloff, Taylor & Zafman LLP

(57) ABSTRACT

Disclosed herein is a subminiature internal antenna, which exhibits a multi-band characteristic. The internal antenna includes a radiator electrically coupled at one end thereof to a feed element of a communication device and formed in a spiral shape as a whole. The radiator is disposed in such a manner as to extend at the other end thereof outwardly from the spiral shape. According to the present invention, the electromagnetic coupling is achieved in the radiator of the internal antenna and the other end of the radiator is disposed outwardly from the spiral shape so that the radiation interference is reduced to thereby obtain the multi-band characteristic.

6 Claims, 2 Drawing Sheets

OTHER PUBLICATIONS

Best, Steven R., "A Comparison of the Resonant Properties of Small Space-Filling Fractal Antennas," IEEE Antennas and Wireless Letters, vol. 2, Issue-1, 2003, pp. 197-200.

Nakano, H. et al., "Round Spiral Antennas Printed on a Grounded Dielectric Substrate with A Single Surface Wave Mode," 1988. AP-S. Digest, Jun. 6-10, 1988, pp. 692-695.

Gschwendtner E et al: "Spiral antenna with external feeding for planar applications" AFRICON, 1999 IEEE Cape Town, South Africa Sep. 28-Oct. 1, 1999, vol. 2: pp. 1011-1014 (Sep. 28, 1999).
Supplementary European Search Report for EP Counterpart Patent Application No. EP 06 79 9046, 5 pgs. (Oct. 29, 2009).
Office Action for Japanese Application No. 533257/2008, 2 pgs.
Office Action pertaining to corresponding Chinese application 200680037022.9, dated Apr. 1, 2011, 4 pages.

* cited by examiner

[Fig. 1]
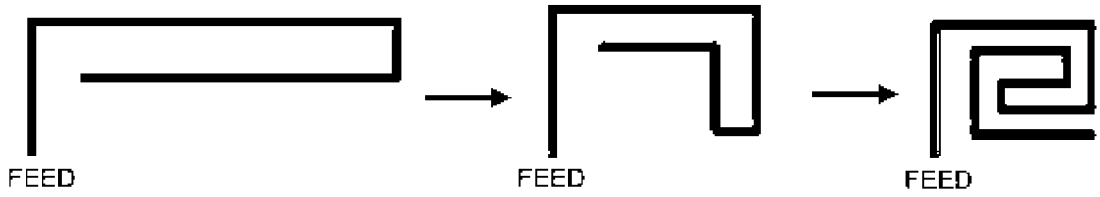
[Fig. 2]
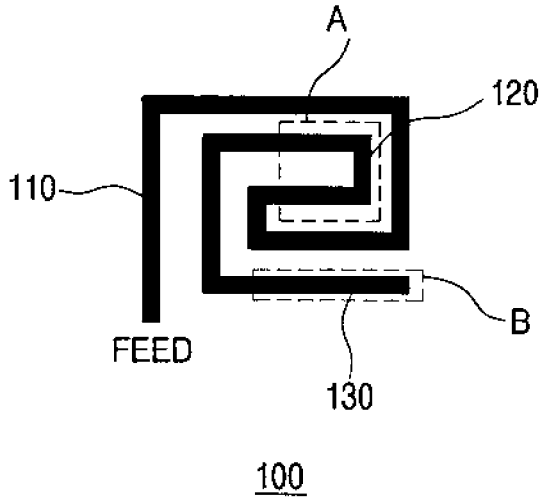
[Fig. 3]
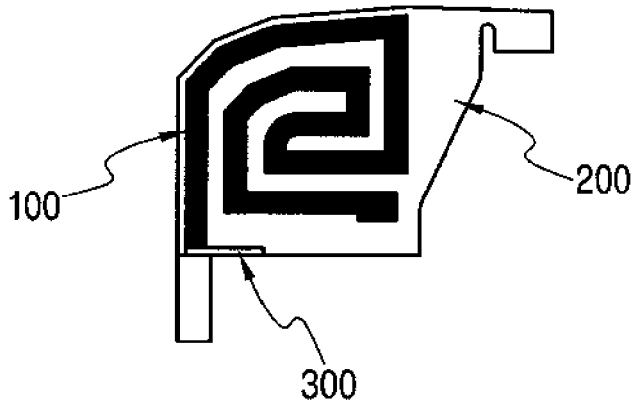

[Fig. 4]
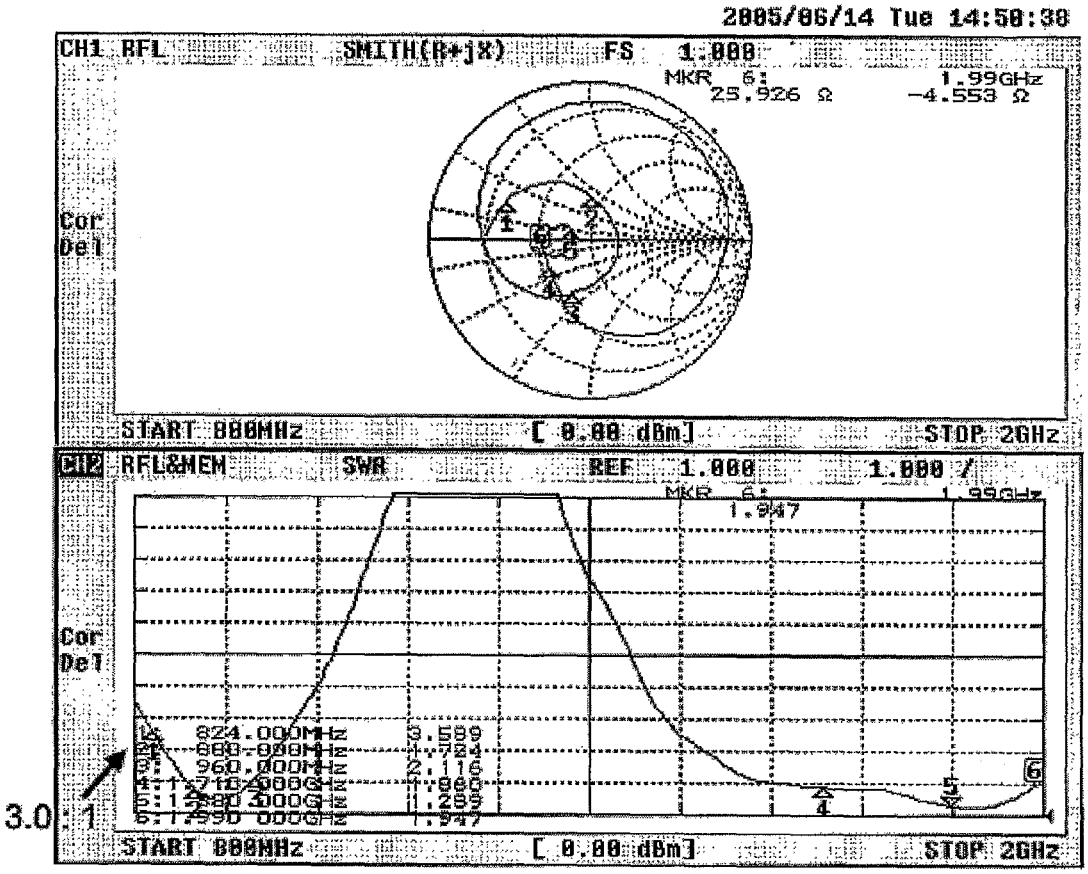
3.0 : 1

SUBMINIATURE INTERNAL ANTENNA

CROSS-REFERENCE TO OTHER APPLICATIONS

This is a National Phase of International Application No. PCT/KR2006/003963, filed on Oct. 2, 2006, which claims priority from Korean Patent Application No. 20-2005-0028301, filed on Oct. 4, 2005.

TECHNICAL FIELD

The present invention relates to a subminiature internal antenna, and more particularly to, a subminiature internal antenna that is embedded in a mobile communication device.

BACKGROUND ART

An antenna of a mobile communication device is typically is subdivided into an external antenna exposedly mounted to the outside thereof and an internal antenna which is mounted to the inside thereof in terms of its installation position. An external antenna such as a helical antenna or a whip antenna is protruded to the outside of the device, and hence has a high risk of damage. In addition, the external antenna has high standing wave ratio so that the radiation characteristic of transmission power is deteriorated to thereby increase the amount of the electric power consumed due to power output control. Also, the external antenna is not suitable for a trend toward miniaturization of the device since it is protrudingly mounted to the outside of the device. Thus, currently, the external antenna is being replaced with an internal antenna except for a communication scheme employing a low frequency band.

A conventional internal antenna basically has an inverted-F type or an inverted-L type structure in which a conductive radiator is disposed on a separate dielectric support element. Such an internal antenna can be made relatively small as compared to the external antenna, but a miniaturization of the communication device requires a much smaller antenna since the antenna still occupies a large space inside the device. In addition, as the function of the device becomes diverse and various communication services are introduced, the necessity increases that a single device must transmit/receive signals of various frequency bands. Therefore, it is required that the antenna also exhibits a multi-band characteristic. However, the conventional internal antenna is not proper for implementation of the multi-band characteristic under the limitation of a space for forming an antenna radiator.

A miniature spiral antenna using a spiral-shaped conductive radiator is disclosed in the International Publication No. WO 00/03453 of Ying et al., and U.S. Pat. No. 5,929,825 granted to Niu et al. However, Ying and Niu have implemented miniaturization of the antenna, but not a miniature internal antenna with the multi-band characteristic.

DISCLOSURE OF INVENTION

Technical Problem

Accordingly, the present invention has been made to address and solve the above-mentioned problems occurring in the prior art, and it is an object of the present invention to provide a subminiature internal antenna which has an excellent antenna characteristic and a broadband characteristic while the antenna occupying a much smaller installation space inside a communication device as compared to a conventional internal antenna.

Technical Solution

To accomplish the above object, according to one aspect of the present invention, there is provided an internal antenna including a radiator electrically coupled at one end thereof to a feed element of a communication device and formed in a spiral shape as a whole, wherein the radiator at the other end thereof extends outwardly from the spiral shape.

The radiator may be further electrically coupled to a ground plane of the communication device, and may be formed on a printed circuit board.

To accomplish the above object, according to another aspect of the present invention, there is provided an internal antenna including a radiator made of a electrically conductive material, wherein the radiator comprises: a feeding section electrically coupled to a feed element of a communication device; a first conductor connected to the feeding section, the first conductor having an open-loop shape; a second conductor connected to the first conductor and disposed at the inside of the first conductor, the second conductor being bent at least one times; and a third conductor connected to the second conductor and extending outwardly from the first conductor.

The radiator may further comprise a ground section electrically coupled to a ground plane of the communication device, and may be formed on a printed circuit board.

To accomplish the above object, according to still another aspect of the present invention, there is provided a wireless communication device comprising an internal antenna including a radiator electrically coupled at one end thereof to a feed element of a communication device and formed in a spiral shape as a whole, wherein the radiator at the other end thereof extends outwardly from the spiral shape.

To accomplish the above object, according to yet another aspect of the present invention, there is provided a wireless communication device having an internal antenna including a radiator made of a electrically conductive material, wherein the radiator comprises: a feeding section electrically coupled to a feed element of a communication device; a first conductor connected to the feeding section, the first conductor having an open-loop shape; a second conductor connected to the first conductor and disposed at the inside of the first conductor, the second conductor being bent at least one times; and a third conductor connected to the second conductor and extending outwardly from the first conductor.

Advantageous Effects

As described above, the subminiature internal antenna according to the present invention has an excellent resonance characteristic at a multi-band and a broadband characteristic at a high-frequency band while occupying a much smaller installation space inside a communication device.

In addition, according to the present invention, the inside space of the communication device occupied by the internal antenna can be minimized so as to install still more parts in the communication device to thereby implement various functions.

BRIEF DESCRIPTION OF THE DRAWINGS

FIG. 1 is a schematic view illustrating a principle of forming a spiral radiator of a subminiature internal antenna according to one embodiment of the present invention;

FIG. 2 is a top plan view illustrating a spiral radiator of a subminiature internal antenna according to one embodiment of the present invention;

FIG. 3 is a top plan view illustrating a subminiature internal antenna according to one embodiment of the present invention; and FIG. 4 is a graph illustrating a radiation characteristic of a subminiature internal antenna according to one embodiment of the present invention.

BEST MODE FOR CARRYING OUT THE INVENTION

Reference will now be made in detail to a preferred embodiment of the present invention with reference to the attached drawings.

It will be understood by those skilled in the art that the embodiments described in the specification are merely exemplary and can be changed or modified into various different forms.

In the meantime, as used herein, the term "electric coupling" or "electrically coupled" refers to a state where two constituent elements are electrically connected to each other to allow electrons to be communicated as well as a state where two constituent elements are electromagnetically coupled to each other to induce current mutually although electrons are not allowed to be communicated.

FIG. 1 is a schematic view illustrating a principle of forming a spiral radiator of a subminiature internal antenna according to one embodiment of the present invention. The spiral radiator of the internal antenna is formed based on a principle of a monopole antenna. That is, the radiator is electrically coupled at one end thereof to a feed element inside of a communication device and has an electrical length of substantially $\lambda/4$, where $\lambda$ is an operation wavelength of an antenna. In this embodiment, the radiator of the internal antenna is formed in a spiral shape as a whole and is at the other end thereof bent such that the other end thereof extends outward of the spiral shape. Thus, the entire physical size of the antenna radiator can be greatly reduced while maintaining its electric length as it is.

The antenna radiator according to this embodiment of the present invention may be disposed in parallel with a ground plane and electrically coupled to a feed line perpendicular to the ground plane so as to be operated as an inverted-L type antenna. Alternatively, antenna radiator may be coupled to both the feed element and the ground plane, so that it can be operated as an inverted-F type antenna. Besides, it will be apparent to those skilled in the art that the construction of a variety of antennas such as a roof antenna, a dipole antenna, a micro-strip antenna, etc., can be applied to the antenna of the present invention.

The construction of the antenna radiator of this embodiment will be described in detail hereinafter. FIG. 2 is a top plan view illustrating a spiral radiator of a subminiature internal antenna according to one embodiment of the present invention. As above, the radiator of the present embodiment includes a feeding section electrically coupled to a feed element of a communication device and a first conductor 110 connected to the feeding section, which extends from the feeding section to have an open-loop shape. At the inside of the first conductor 110 is connectively disposed a second conductor 120 which is bent at least one times. In this manner, the second conductor 120 is disposed inside the first conductor 110, so that the physical size of the antenna can be reduced greatly while maintaining the electrical length of the antenna as it is.

Moreover, since the second conductor 120 is disposed inside the first conductor 110, the electromagnetic coupling between the first and second conductors 110 and 120. And the second conductor 120 formed to be bent at least one times results the electromagnetic coupling between conductors in bent region A. As a result, the bandwidth of the antenna is widened and/or the antenna has a multi-band characteristic. Such an effect is particularly superior with respect to a high-frequency signal.

In the meantime, to the second conductor 120 is connected a third conductor 130 which extends outwardly from the first conductor 110. Specifically, the third conductor 130 extends such that its end portion B is disposed outside of the first conductor 110. The end portion B of the third conductor 130 is a distal end of the radiator and a point where the radiation of an electromagnetic wave is concentrated. Therefore, the third conductor 130 extending outwardly from the first conductor 130 allows a maximum radiation point can be relatively separated from the first and second conductors 110 and 120, and the radiation efficiency can be increased. Particularly, this effect is superior with respect to a relatively low frequency signal. Resultantly, this contributes to implementation of a multi-band characteristic of the antenna along with the electromagnetic coupling in the first and second conductors 110 and 120.

Such an antenna radiator can be disposed on a given shaped dielectric material. Since the wavelength of an electromagnetic wave inside the dielectric material is inversely proportional to the square root of the dielectric constant of the dielectric material, the antenna can be miniaturized by increasing the dielectric constant of the dielectric material.

FIG. 3 is a top plan view illustrating a subminiature internal antenna according to one embodiment of the present invention. The radiator 100 of the internal antenna is disposed on a dielectric material 200. At the feeding section of the radiator is formed a terminal 300 for the easy electric coupling between an external circuit such as the feed element, for example. A printed circuit board (PCB) may be used as the dielectric material 200. The radiator 100 and the terminal 300 may be formed by means of a well-known circuit forming method, e.g., printing, etching, etc. Accordingly, the internal antenna can be realized at a lower cost and in a simpler and easier manner. Further, the dielectric material 200 can firmly support the radiator 100 and facilitate the installation of the internal antenna inside the communication device.

The internal antenna of the present invention has been implemented and simulated. The inventive internal antenna has been implemented in an inverted-L type by using a radiator having an electrical length of 80 mm (i.e., ¼ wavelength of a 900 MHz signal). The dimension of the implemented antenna is a width of 16.5 mm, a length of 16.0 mm and a height of 1.0 mm (16.5 mm×16.0 mm×1.0 mm).

FIG. 4 is a graph illustrating a radiation characteristic of a subminiature internal antenna according to one embodiment of the present invention. Specifically, the upper portion of the graph of FIG. 4 shows a smith chart indicating impedance change according to frequency change and the lower portion of the graph shows the relationship between a frequency and voltage standing wave ratio (VSWR) of the internal antenna. It could be found from the graph of FIG. 4 that since the implemented antenna has a VSWR value of less than 3:1 at approximately 0.8 to 1 GHz and 1.57 to 2.2 GHz, there exist two available frequency bands. In addition, it could be seen from the graph of FIG. 4 that the internal antenna has a broadband characteristic at 1.57 to 2.2 GHz. Especially, since the obtained bandwidth includes cellular service band of 824 to 894 MHz, Global System for Mobile communications (GSM) service band of 880 to 960 MHz, Digital Cellular System service band of 1710 to 1880 MHz, and US Personal Communications Service (US-PCS) band of 1850 to 1990 MHz, it can cover all of the four services and substantially functions as a quadruple band antenna.

Furthermore, it was assured from the fact that an average gain in the above four service bands is −6.21 dBi, −4.31 dBi, −2.52 dBi and −2.92 dBi, respectively, and the maximum gain in the above four service bands is −2.83 dBi, −1.18 dBi, 1.31 dBi and 1.07 dBi, respectively, that the service band of the internal antenna has a good gain.

While the invention has been described in connection with particular embodiments, it is to be understood that those are merely exemplary and the invention is not limited to the disclosed embodiments. For example, the radiator of the internal antenna described as being bent with a certain angle may be bent in a smooth curved shape, and the dielectric material may have various forms other than that shown or described herein. Therefore, a person skilled in the art can perform various changes and modifications based on a principle of the present invention, which falls in the scope of the present invention.

What is claimed is:

1. An internal antenna including a radiator made of an electrically conductive material, wherein the radiator comprises:

a feeding section electrically coupled to a feed element of a communication device;

a first conductor connected to the feeding section, the first conductor having an open-loop shape;

a second conductor connected to the first conductor and disposed at the inside of the first conductor, the second conductor being bent at least one times; and a third conductor connected to the second conductor and extending outwardly from the first conductor.

2. The internal antenna as defined in claim 1, wherein the radiator further comprises a ground section electrically coupled to a ground plane of the communication device.

3. The internal antenna as defined in claim 1, wherein the radiator is formed on a printed circuit board.

4. A wireless communication device having an internal antenna including a radiator made of an electrically conductive material, wherein the radiator comprises:

a feeding section electrically coupled to a feed element of a communication device;

a first conductor connected to the feeding section, the first conductor having an open-loop shape;

a second conductor connected to the first conductor and disposed at the inside of the first conductor, the second conductor being bent at least one times; and a third conductor connected to the second conductor and extending outwardly from the first conductor.

5. The wireless communication device as defined in claim 4, wherein the radiator further comprises a ground section electrically coupled to a ground plane of the communication device.

6. The wireless communication device as defined in claim 4, wherein the radiator is formed on a printed circuit board.

* * * * *